US007828700B1

(12) United States Patent
Tsai

(10) Patent No.: US 7,828,700 B1
(45) Date of Patent: Nov. 9, 2010

(54) EXERCISE MACHINE

(76) Inventor: Cheng-Ta Tsai, 7F-1, No. 298, Rueiguang Rd., Neihu Dist., Taipei (TW)

( * ) Notice: Subject to any disclaimer, the term of this patent is extended or adjusted under 35 U.S.C. 154(b) by 0 days.

(21) Appl. No.: 12/585,258

(22) Filed: Sep. 10, 2009

(51) Int. Cl.
*A63B 69/06* (2006.01)

(52) U.S. Cl. ..... 482/72; 482/121; 482/131

(58) Field of Classification Search ..... 482/72, 482/92, 121, 122, 126, 129, 130, 131, 133–138, 482/148, 907, 908, 142; 601/23, 24, 33, 601/34, 35; D21/676, 686, 690, 695
See application file for complete search history.

(56) References Cited

U.S. PATENT DOCUMENTS 4,647,040 A * 3/1987 Ehrenfried ..... 482/131
4,844,453 A * 7/1989 Hestilow ..... 482/131
5,277,681 A * 1/1994 Holt ..... 482/112
5,616,110 A * 4/1997 Nascimento ..... 482/131
5,904,641 A * 5/1999 Huang ..... 482/131
6,352,495 B1 * 3/2002 Hsu ..... 482/92
6,733,426 B2 * 5/2004 Bussell ..... 482/112
6,821,231 B1 * 11/2004 Hall ..... 482/51
6,926,647 B1 * 8/2005 Huang et al. ..... 482/72
7,340,786 B1 * 3/2008 Smith ..... 5/648
7,485,078 B1 * 2/2009 Chen ..... 482/130
2005/0209068 A1 * 9/2005 Lincoln ..... 482/92

* cited by examiner

*Primary Examiner*—Nicholas D Lucchesi
*Assistant Examiner*—Tam Nguyen
(74) *Attorney, Agent, or Firm*—Bacon & Thomas, PLLC

(57) ABSTRACT

An exercise machine has a stand, a linking assembly, an elastic member, a seat, two handles, two pedals and two wheels. The linking assembly is mounted pivotally on the stand. The elastic member is connected to the stand and the linking assembly. The seat is mounted on the stand. The handles, the pedals and the wheels are attached to the linking assembly. The handles are operated against the elastic members and the linking assembly moves to drive an exerciser's legs to stretch out. Therefore, the exercise machine provides the exerciser to train the muscles of the arms and the legs synchronously.

8 Claims, 5 Drawing Sheets

EXERCISE MACHINE

BACKGROUND OF THE INVENTION

1. Field of the Invention

The present invention relates to an exercise machine, and more particularly to an exercise machine that allows an exerciser to train muscles of arms and legs synchronously.

2. Description of the Prior Arts

Exercise machines are popular because they allow exercisers for keep healthy by allowing exerciser to be performed indoors conveniently and safely.

Conventional exercise machines are designed according to the movements of real exercises or gravity training, for instance, stepper machines, treadmills, stationary bicycles, weight machines or the like. However, a conventional exercise machine only allows one specific part of the body to be trained. Therefore, training different parts of the body is difficult or multiple exercise machines must be used.

To overcome the shortcomings, the present invention provides an exercise machine to mitigate or obviate the aforementioned problems.

SUMMARY OF THE INVENTION

The main object of the present invention is to provide an exercise machine for spreading arms and legs and training muscles of the arms and the legs synchronously.

An exercise machine comprises a stand, a linking assembly, an elastic member, a seat, two handles, two pedals and two wheels. The linking assembly is mounted pivotally on the stand. The elastic member is connected to the stand and the linking assembly. The seat is mounted on the stand. The handles, the pedals and the wheels are attached to the linking assembly. The handles are operated against the elastic members and the linking assembly moves to drive an exerciser's legs to stretch out. Therefore, the exercise machine provides for training of muscles of the arms and the legs synchronously.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
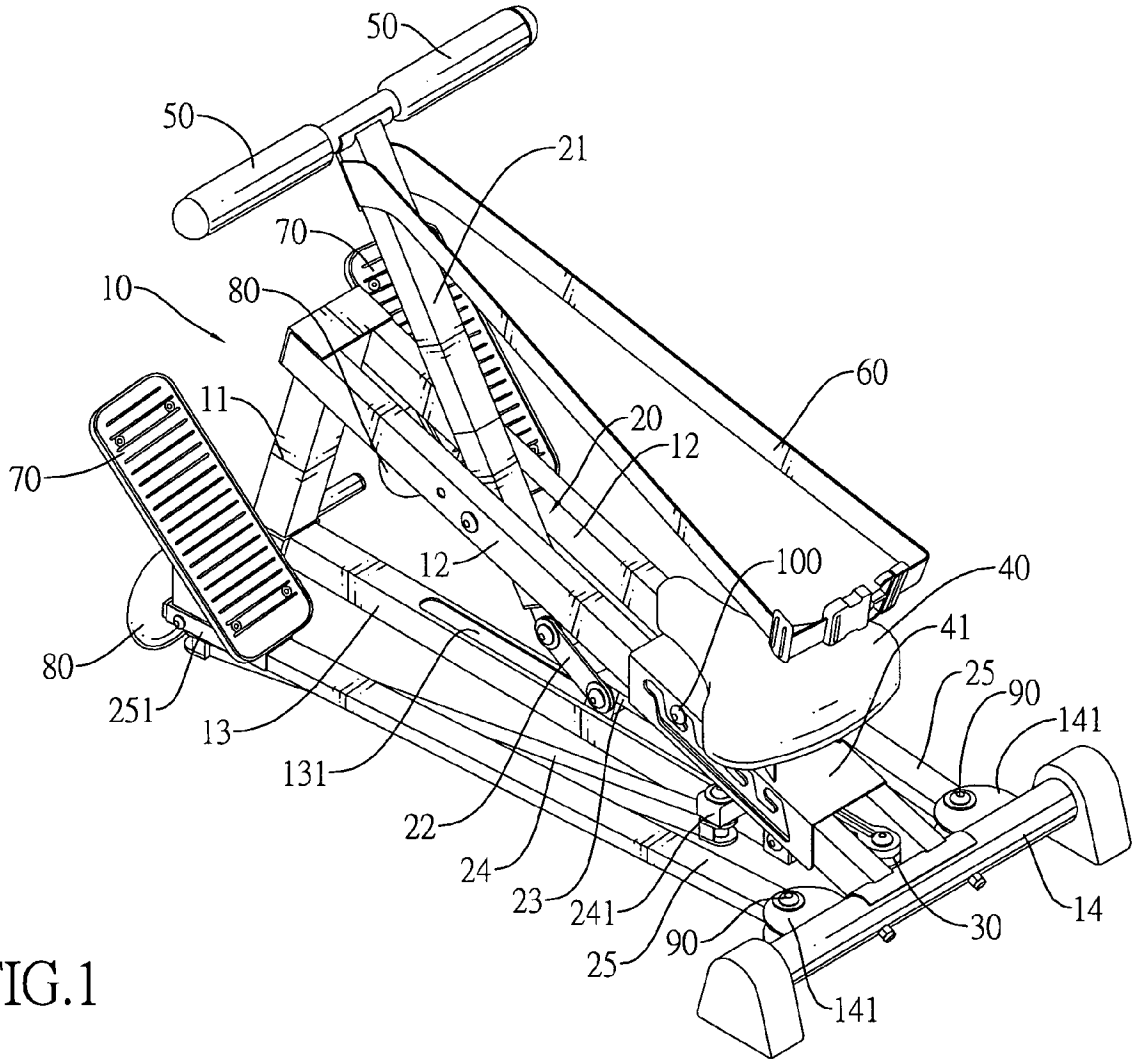
FIG. 1 is a perspective view of an exercise machine in accordance with the present invention.

With reference to FIG. 1, an exercise machine in accordance with the present invention comprises a stand (10), a linking assembly (20), an elastic member (30), a seat (40), two handles (50), a retaining belt (60), two pedals (70) and two wheels (80).

The stand (10) has a support rod (11), two connecting rods (12), a rail (13) and a foot (14). The support rod (11) has two sides, a top end and a bottom end. The connecting rods (12) are parallel to each other and are connected to and inclined relative to the support rod (11). Each connecting rod (12) has a front end, a rear end, a middle section and a back section. The front ends of connecting rods (12) are respectively mounted on the sides and the top end of the support rod (11). The rail (13) is connected to the bottom end of the support rod (11) and has a top surface and a sliding channel (131). The sliding channel (131) is formed axially in the top surface of the rail (13). The foot (14) is mounted on the rear ends of the connecting rods (12) and has two sides and two pivot bracket (141). The pivot brackets (141) are respectively mounted securely on the sides of the foot (14).

Figure 2:
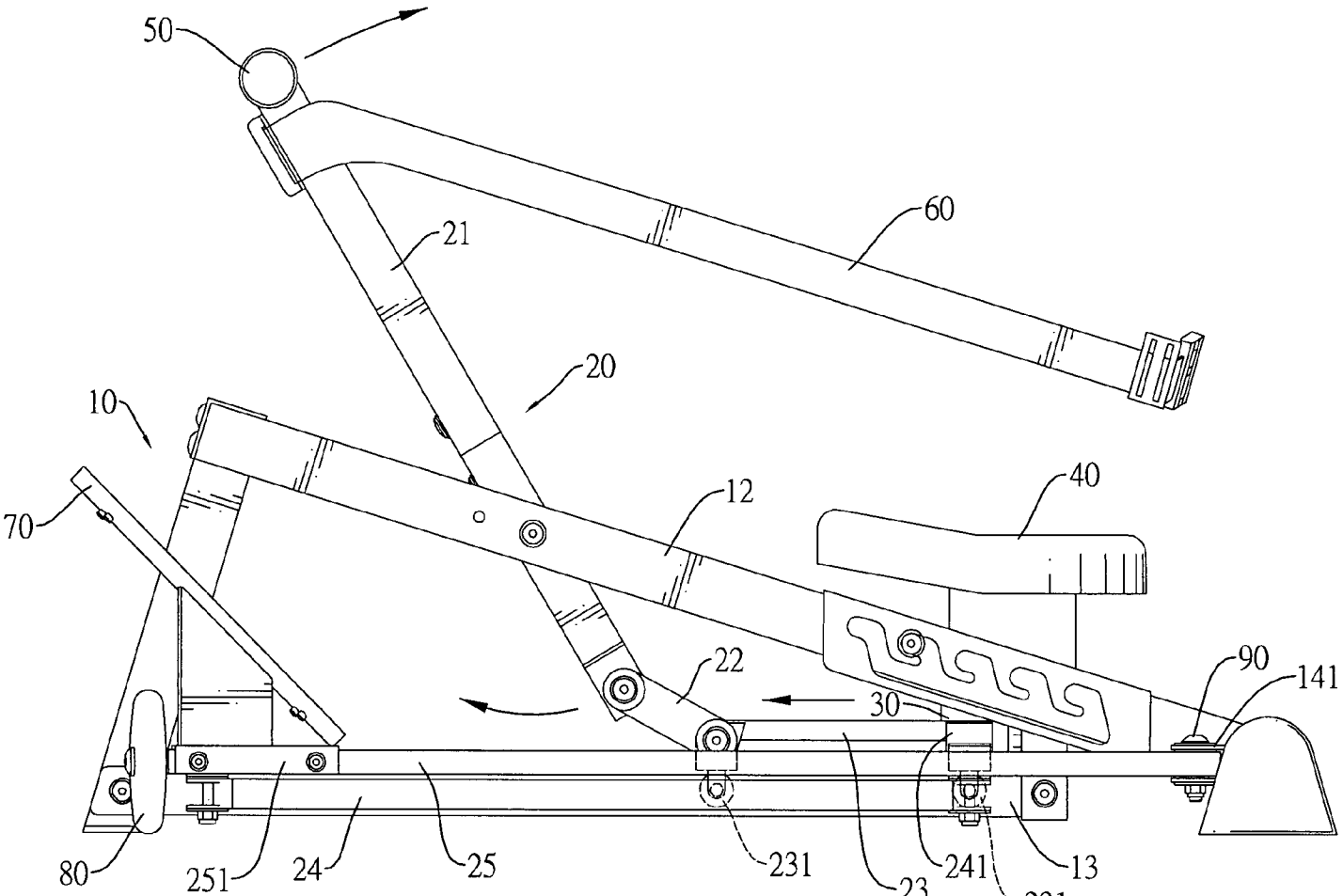
FIG. 2 is a side view of the exercise machine in FIG. 1.
Figure 3:
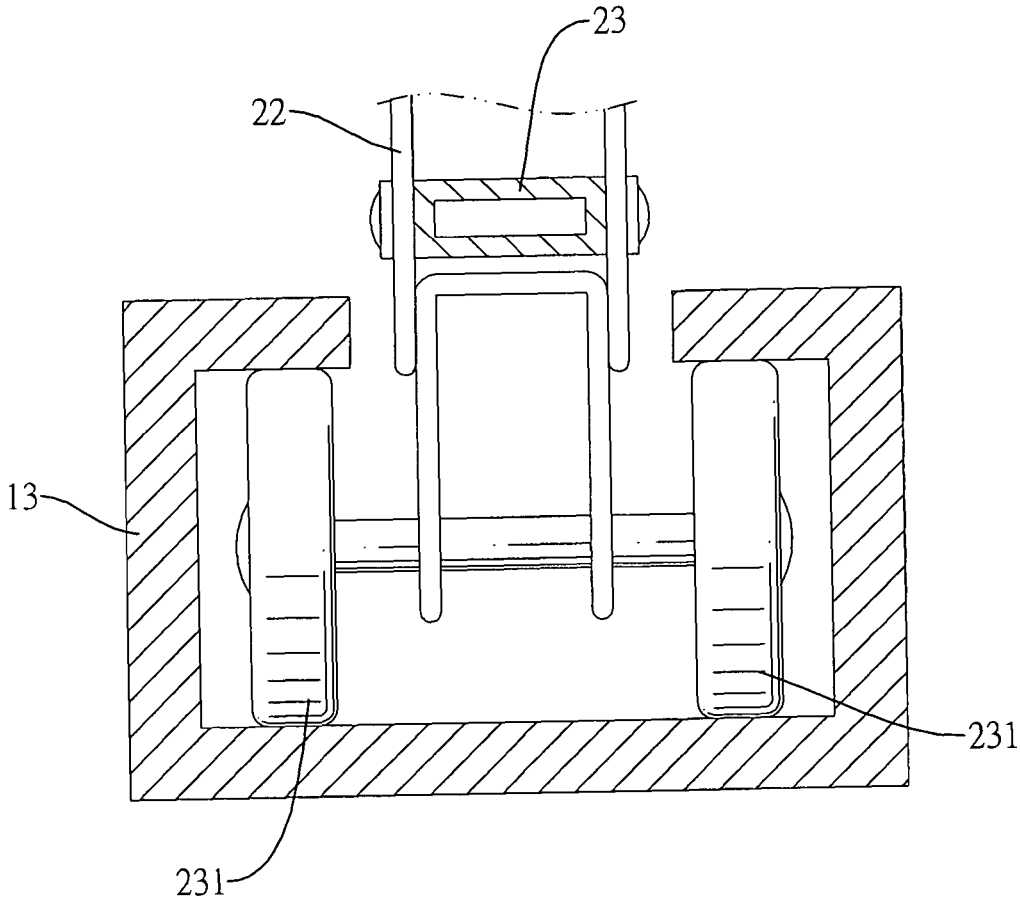
FIG. 3 is an enlarged front view in partial section of the exercise machine in FIG. 1, showing a slide mounted in a rail.

With further reference to FIGS. 2 and 3, the linking assembly (20) is connected pivotally to the stand (10) and has a pivot linking rod (21), a driven linking rod (22), a connecting linking rod (23), an inner bracket (241), two inside linking rods (24), two outer brackets (251) and two outside linking rods (25).

The pivot linking rod (21) is mounted pivotally on the middle sections of the connecting rods (12) and has a top end and a bottom end. The driven linking rod (22) is mounted pivotally on the pivot linking rod (21) and has a moving end and a pivoting end. The moving end of the driven linking rod (22) is mounted pivotally on the bottom end of the pivot linking rod (21).

The connecting linking rod (23) is mounted pivotally on the pivoting end of the driven linking rod (22) and has an end surface and two slides (231). The slides (231) are respectively mounted on the sides and the end surface of the driven linking rod (22) and mounted movably in the sliding channel (131) of the rail (13). The slides (231) may be rollers being capable of sliding and rolling in the sliding channel (131) of the rail (13) to facilitate movements of the connecting linking rod (23).

The inner bracket (241) is mounted securely on the connecting linking rod (23) and has two sides.

The inside linking rods (24) are mounted pivotally on the inner bracket (241) and each inside linking rod (24) has a front end and a rear end. The rear ends of the inside linking rods (24) are respectively mounted pivotally on the sides of the inner bracket (241).

The outer brackets (251) are respectively mounted pivotally on the front ends of the inside linking rods (24).

The outside linking rods (25) are respectively mounted between the outer brackets (251) and the pivot brackets (141) of the foot (14) and each outside linking rod (25) has a front end and a rear end. The front ends of the outside linking rods (25) are respectively mounted on the outer brackets (251). The rear ends of the outside linking rods (25) are respectively mounted pivotally on the pivot brackets (141) of the foot (14). A pin (90) is mounted through the pivot bracket (141) and the rear end of the outside linking rod (25) to connect the pivot bracket (141) and the outside linking rod (25) pivotally.

Figure 4:
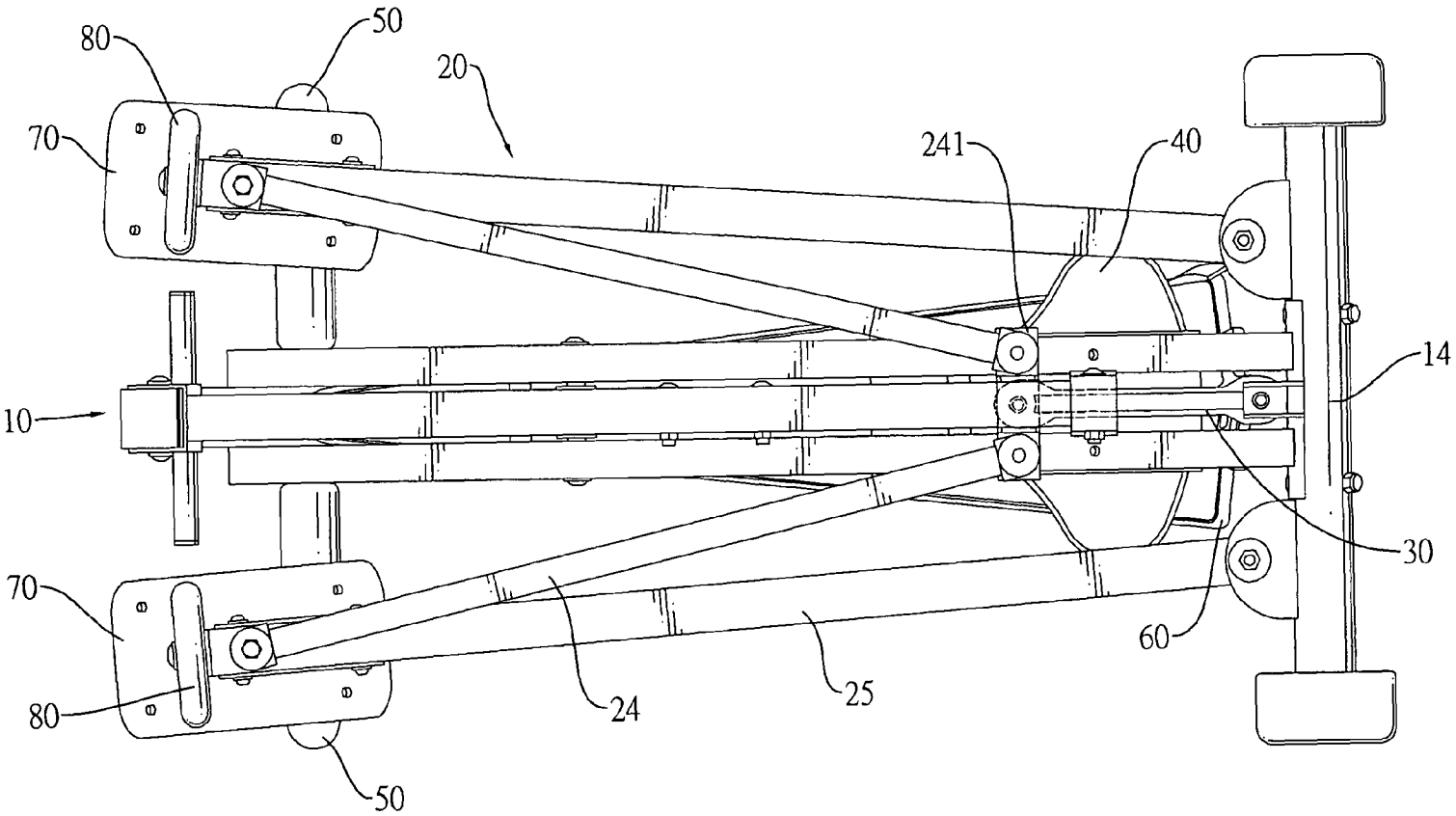
FIG. 4 is an bottom view of the exercise machine in FIG. 1.

With further reference to FIG. 4, the elastic member (30) is mounted between the foot (14) and the inner bracket (241) and selectively provides an elastic force to pull the pivot bracket (241) toward the foot (14). The elastic member (30) may be made of rubber or may be an elastic band or a spring.

The seat (40) is mounted on the stand (10) and has an end surface and an adjusting bracket (41). The adjusting bracket (41) is mounted on the end surface of the seat (40) and mounted slidably through the back sections of the connecting rods (12) to allow different exercisers to adjust a suitable position. Then, a fastener (100) is selectively mounted through the adjusting bracket (41) and the connecting rods (12) to fasten the adjusting bracket (41) and the connecting rods (12) securely.

The handles (50) are respectively attached radially to the top end of the pivot linking rod (21).

The retaining belt (60) is attached to the top end of the pivot linking rod (21) and surrounds an exerciser's waist for exercising safely.

The pedals (70) are respectively attached securely to the outer brackets (251) and may be inclined.

The wheels (80) are respectively mounted on the front end of the outside linking rods (25) under the pedals (70). Each wheel (80) is limited to move in an arc according to the pin (90) acting as a center of a circle and the outside linking rod (25) being a radius.

Figure 5:
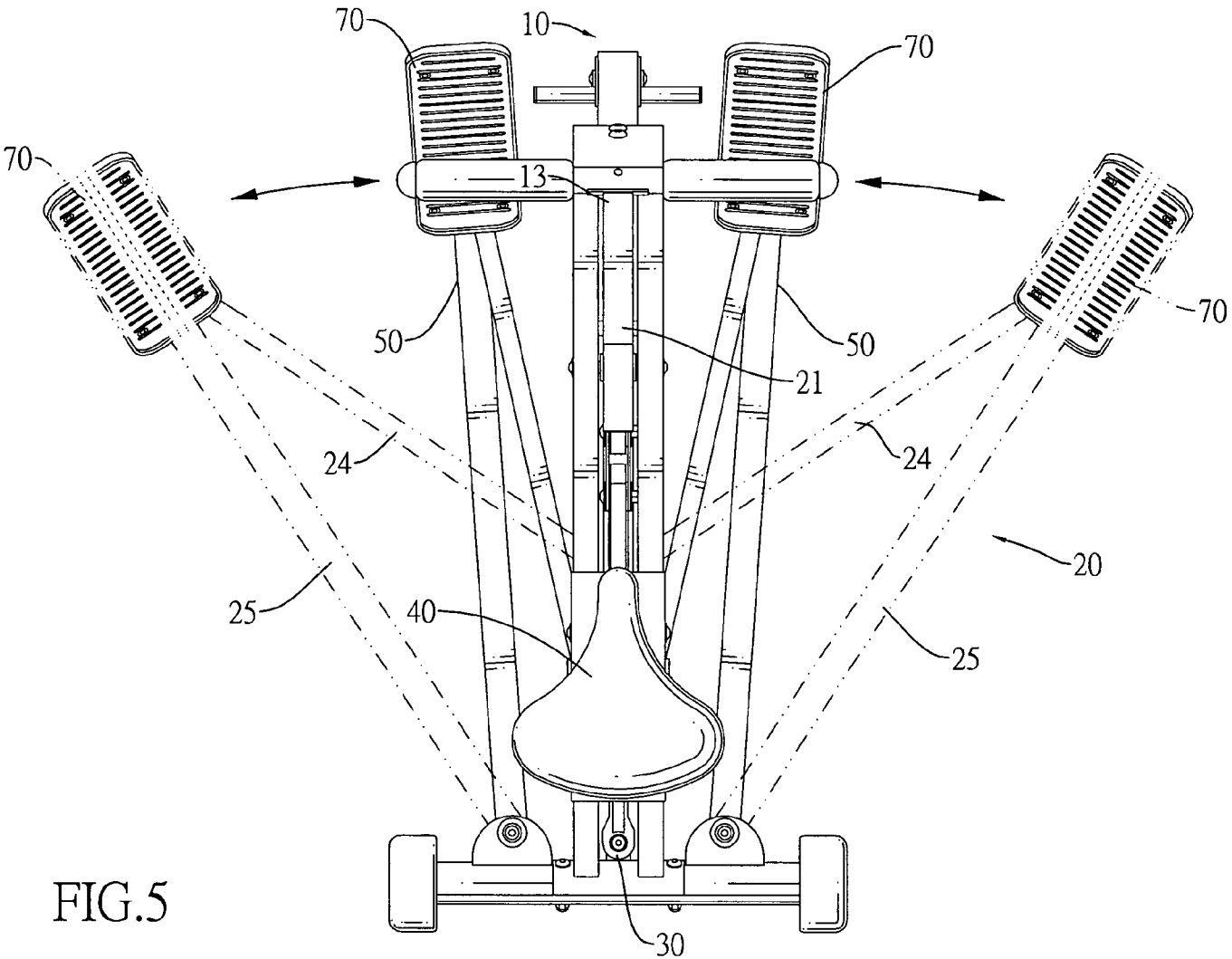
FIG. 5 is an operational top view of the exercise machine in FIG. 1, showing a linking assembly moving.

With reference to FIGS. 2 and 5, an exerciser uses the exercise machine by sitting on the seat (40), holding the handles (50) and stepping on the pedals (70). When the handles (60) are pulled near the exerciser's body and against the elastic force of the elastic member (30), the pivot linking rod (21) is pivoted. Then the driven bracket (22) drives the connecting rod (23) and inner bracket (241) to slide along the sliding channel (131) of the rail (13) forwards. The inside linking rod (24) and the outside linking rod (25) move and drive the wheels (80) to roll distant from the stand (10), and the exerciser's legs can be driven to stretch out sideward.

When the handles (50) are released, the elastic member (30) provides elastic force and the connecting rod (23) and inner bracket (241) slide along the sliding channel (131) of the rail (13) backwards and the pivot linking rod (21) rotates. Then, the inside linking rod (24) and the outside linking rod (25) move and drive the wheels (80) to roll close to the stand (10), and the exerciser's legs can be driven close together and the exerciser's arms can be driven to stretch out forwards. Thus, the muscles of the exerciser's arms and legs are trained synchronously by using the exercise machine in accordance with the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exercise machine comprising:

(a) a stand having a support rod having two sides, a top end and a bottom end;

two connecting rods connected to the support rod and each connecting rod having a front end mounted on one of the sides at the top end of the support rod;

a rear end;

a middle section; and a back section; and a rail connected to the bottom end of the support rod and the rail having sliding channel;

a foot on a rear portion of the stand;

(b) a linking assembly connected pivotally to the stand and having a pivot linking rod mounted pivotally on the middle sections of the connecting rods and the pivot linking rod having a top end and a bottom end;

a driven linking rod mounted pivotally on the pivot linking rod and the driven linking rod having two sides and an end surface;

a moving end mounted pivotally on the bottom end of the pivot linking rod; and a pivoting end;

a connecting linking rod mounted pivotally on the pivoting end of the driven linking rod and the connecting linking rod having an end surface; and two slides respectively mounted on the sides and the end surface of the driven linking rod and mounted movably in the sliding channel of the rail;

two inner brackets mounted securely on the connecting linking rod and each inner bracket having two sides;

two inside linking rods, each mounted pivotally on a respective inner bracket and each inside linking rod having a front end; and a rear end mounted pivotally on the side of a respective inner bracket;

two outer brackets respectively mounted pivotally on the front ends of the inside linking rods; and two outside linking rods respectively mounted between the outer brackets and pivots brackets on the foot and each outside linking rod having a front end mounted on the outer bracket; and a rear end mounted pivotally on the pivot brackets of the foot;

(c) an elastic member mounted between the foot of the stand and the inner bracket of the linking assembly;

(d) a seat mounted on the back sections of the connecting rods;

(e) two handles attached to the top end of the pivot linking rod;

(f) two pedals respectively attached securely to the outer brackets; and (g) two wheels respectively mounted on the front end of the outside linking rods under the pedals wherein when a user pulls on the handles, the linking assembly is actuated to stretch the elastic member and pivot the outside linking rods away from the rail thereby spreading and stretching the legs of a user seated on the seat with the user's feet on the pedals.

2. The exercise machine as claimed in claim 1 further having a retaining belt attached to the top end of the pivot linking rod.

3. The exercise machine as claimed in claim 1, wherein the elastic member is an elastic band.

4. The exercise machine as claimed in claim 2, wherein the elastic member is an elastic band.

5. The exercise machine as claimed in claim 1, wherein the foot is on the rear ends of the connecting rods; and the rear ends of the outside linking rods are mounted pivotally on the foot.

6. The exercise machine as claimed in claim 2, wherein the foot is on the rear ends of the connecting rods; and the rear ends of the outside linking rods are mounted pivotally on the foot.

7. The exercise machine as claimed in claim 3, wherein the foot is on the rear ends of the connecting rods; and the rear ends of the outside linking rods are mounted pivotally on the foot.

8. The exercise machine as claimed in claim 4, wherein the foot is on the rear ends of the connecting rods; and the rear ends of the outside linking rods are mounted pivotally on the foot.

* * * * *